United States Patent [19]

Britzke et al.

[11] Patent Number: 4,942,825

[45] Date of Patent: Jul. 24, 1990

[54] CONNECT PLATFORM FOR RAIL VEHICLES

[76] Inventors: Ingo Britzke, Stellbergweg 8, D-3500 Kassel; Peter Braemert, Rubensstrasse 2, D-3340 Wolfenbüttel, both of Fed. Rep. of Germany

[21] Appl. No.: 318,697

[22] Filed: Mar. 3, 1989

[30] Foreign Application Priority Data

Mar. 4, 1988 [DE] Fed. Rep. of Germany ..... 3807167
Nov. 24, 1988 [EP] European Pat. Off. ..... 88119662.2.0

[51] Int. Cl.[5] ..... B61D 17/20; B60D 5/00
[52] U.S. Cl. ..... 105/18; 105/15
[58] Field of Search ..... 105/18–20, 105/15–17, 8.1, 425, 463.1; 280/403

[56] References Cited

U.S. PATENT DOCUMENTS

| | | | |
|---|---|---|---|
| 1,727,642 | 9/1929 | Griffin | 105/18 |
| 2,124,264 | 7/1938 | Simonson | 105/17 |
| 2,217,599 | 10/1940 | Seel | 105/8.1 |
| 2,408,473 | 10/1946 | Nelson | 105/20 |
| 2,643,617 | 6/1953 | Nystrom et al. | 105/15 |
| 3,387,568 | 6/1968 | Hawes | 105/18 X |
| 3,486,464 | 12/1969 | Dean et al. | 105/17 X |
| 4,318,345 | 3/1982 | Kleim | 105/17 X |
| 4,503,779 | 3/1985 | Chadwick | 105/18 X |
| 4,599,947 | 7/1986 | Keefer | 105/15 |
| 4,690,421 | 9/1987 | Schmidt et al. | 105/18 X |
| 4,736,688 | 4/1988 | Ando et al. | 105/18 X |
| 4,762,071 | 8/1988 | Ohta et al. | 105/8.1 |
| 4,765,249 | 8/1988 | Ishizuka et al. | 105/17 X |
| 4,781,123 | 11/1988 | Yoshihara | 105/8.1 |
| 4,819,565 | 4/1989 | Bechu | 105/15 X |

FOREIGN PATENT DOCUMENTS

| | | | |
|---|---|---|---|
| 3541367 | 6/1986 | Fed. Rep. of Germany | 105/18 |

*Primary Examiner*—Douglas C. Butler
*Attorney, Agent, or Firm*—Alan H. Levine

[57] ABSTRACT

The object of the invention is a diaphragm for passsenger railway cars, which consists of a platform (5) and a diaphragm (36, 2, 3) disposed in tunnel fashion over the platform. The system is so constructed that it provides good protection for the interior against external influences even when the differences in pressure between the outside and inside are extreme. The tunnel-like diaphragm consists of an inner end frame (36) for fastening to one of two railroad passenger cars coupled together, an outer end frame (3) for cooperation with the outer end frame of the connecting platform of the second of two coupled railroad passenger cars, and a resilient member, especially a bellows (2) between the two end frames (36) and (3). The outer end frames (3) is suspended by springs (**4*a*) directly on one of the two passenger cars, and the springs exert an outwardly directed force on the outer end frame (3). The connecting platform is made in two parts, of which an inner part (9) is fastened to one of the two passenger cars to be coupled together, and the other, outer part (6*a*) is displaceably supported at the read end on the inner part, is joined to the outer end frame ( 3) at the front end, and terminates in the same vertical cross plane as the outer end frame. The outer end frame is provided with a thrusting surface (4, 4*b*), so that, when two passenger train cars are coupled together, the connecting platforms and the shelter of the two diaphragm systems will abut one another face to face and be held in contact with one another by the springs (4*a*) so that no fasteners are needed, and yet the junction between the two diaphragms is sealed off, even when allowable lateral shifting between the two diaphragms takes place. The diaphragm and platform are sealed against one another. The outer end frame (3**) is of a tunnel-like configuration, and its relatively long side walls have flaps in the front, lower region, which close openings, into which the platform of a second passenger train coupled to the first can enter when this platform deviated from the platform of the other car such that it enters in the form of a plate into the diaphragm system of the first car and rests upon its connecting platform.

24 Claims, 6 Drawing Sheets

Figure 1:
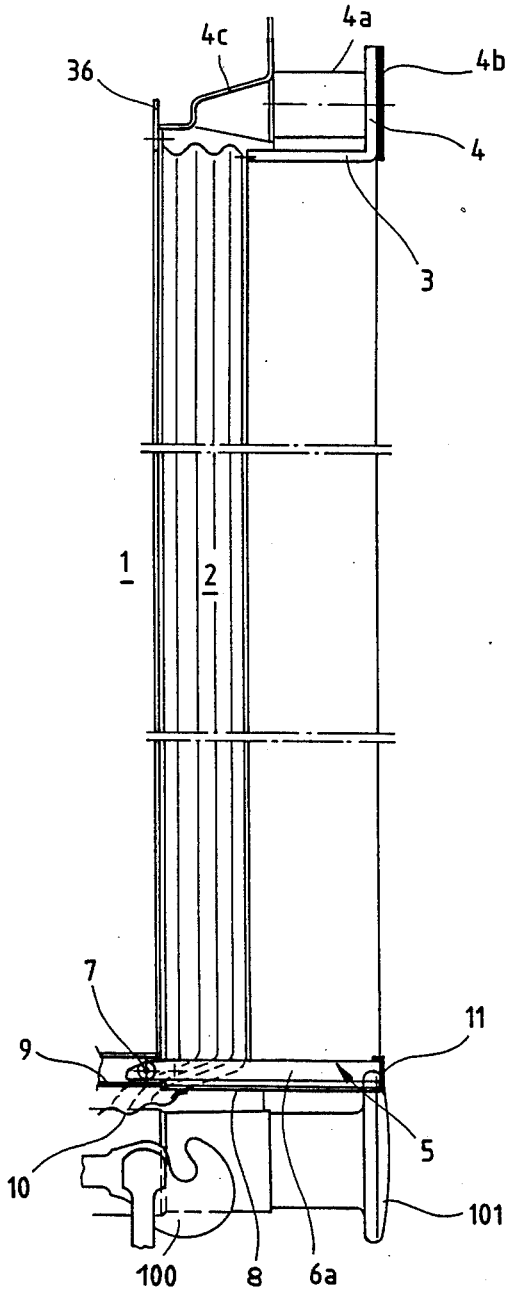

Fig. 4a
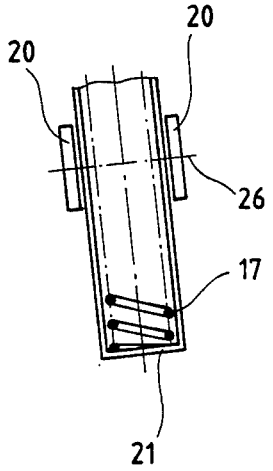
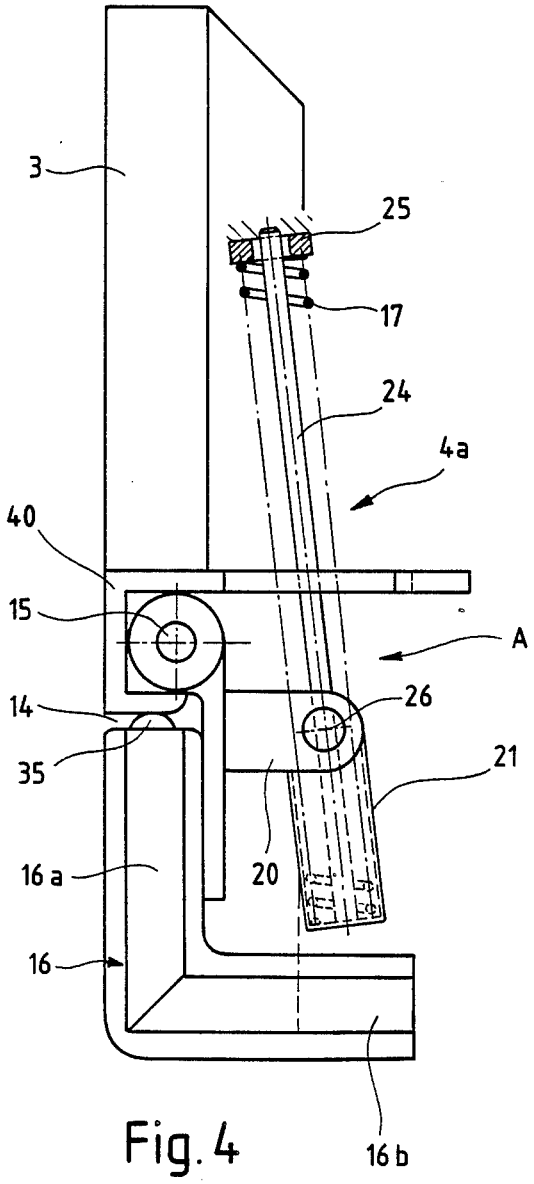
Fig. 4

CONNECT PLATFORM FOR RAIL VEHICLES

The invention relates to a covered connecting platform or diaphragm located at the end of a railroad car.

The invention is addressed to the problem of improving such a connecting platform such that, in cooperation with a similar inventive covered platform on a second railroad car, it will surround an interior space between the two railroad cars, which will be protected against turbulent air and dirt even at extremely high running speeds, but which will nevertheless create a hatchway conveniently accessible to a brakeman, and which, in a further development, can also be coupled to conventional covered platforms so that vehicles with conventional connecting platforms and diaphragms can be coupled with a vehicle equipped pursuant to the invention.

Figure 3:
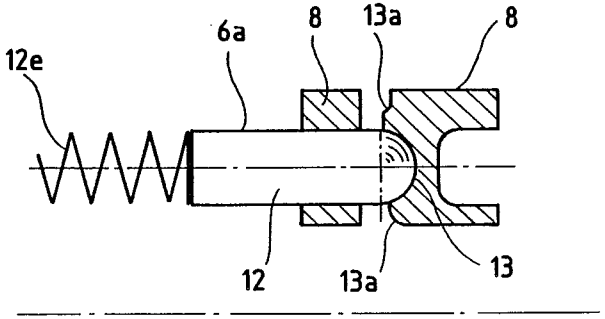
Figure 2:
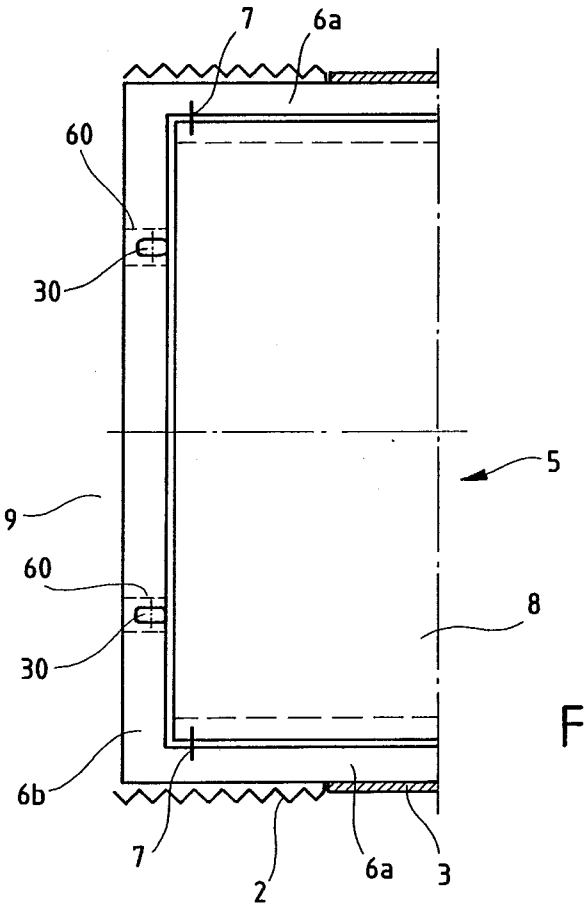
Figure 5:
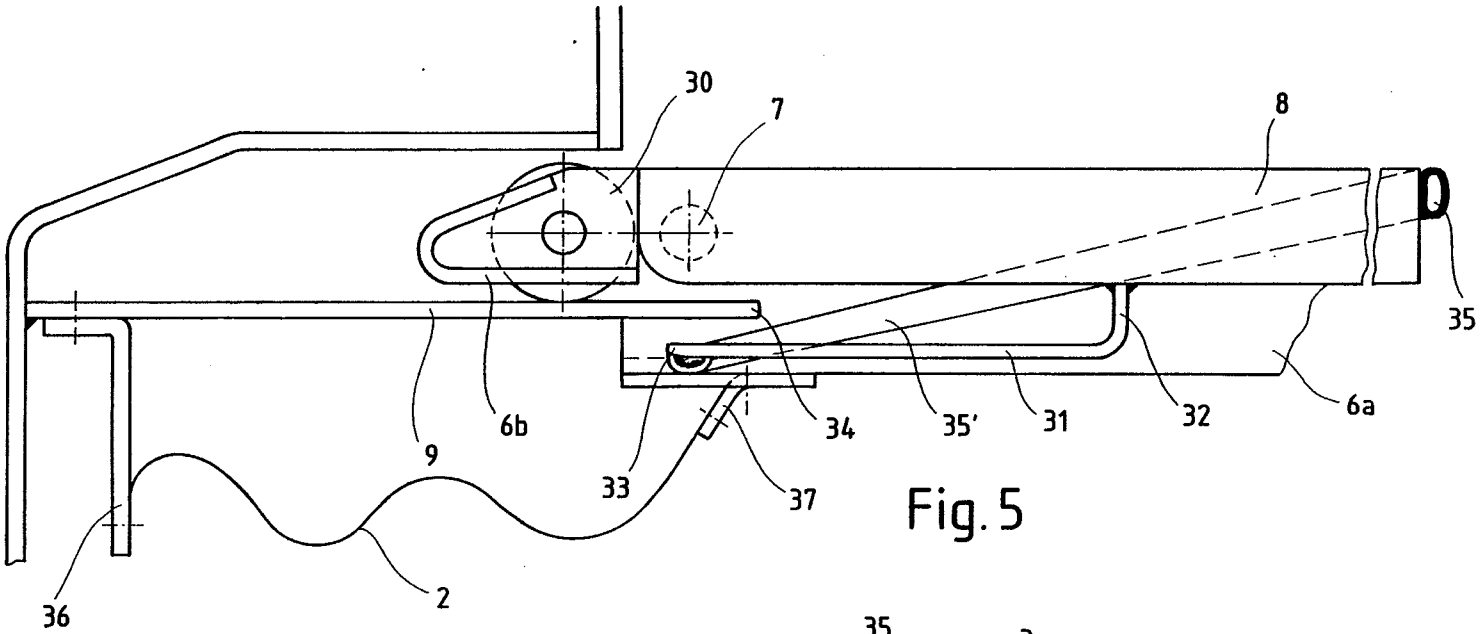
Figure 6:
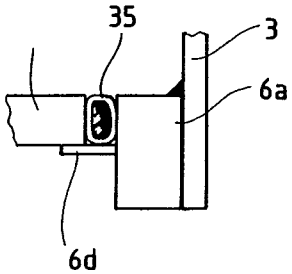
Figure 7:
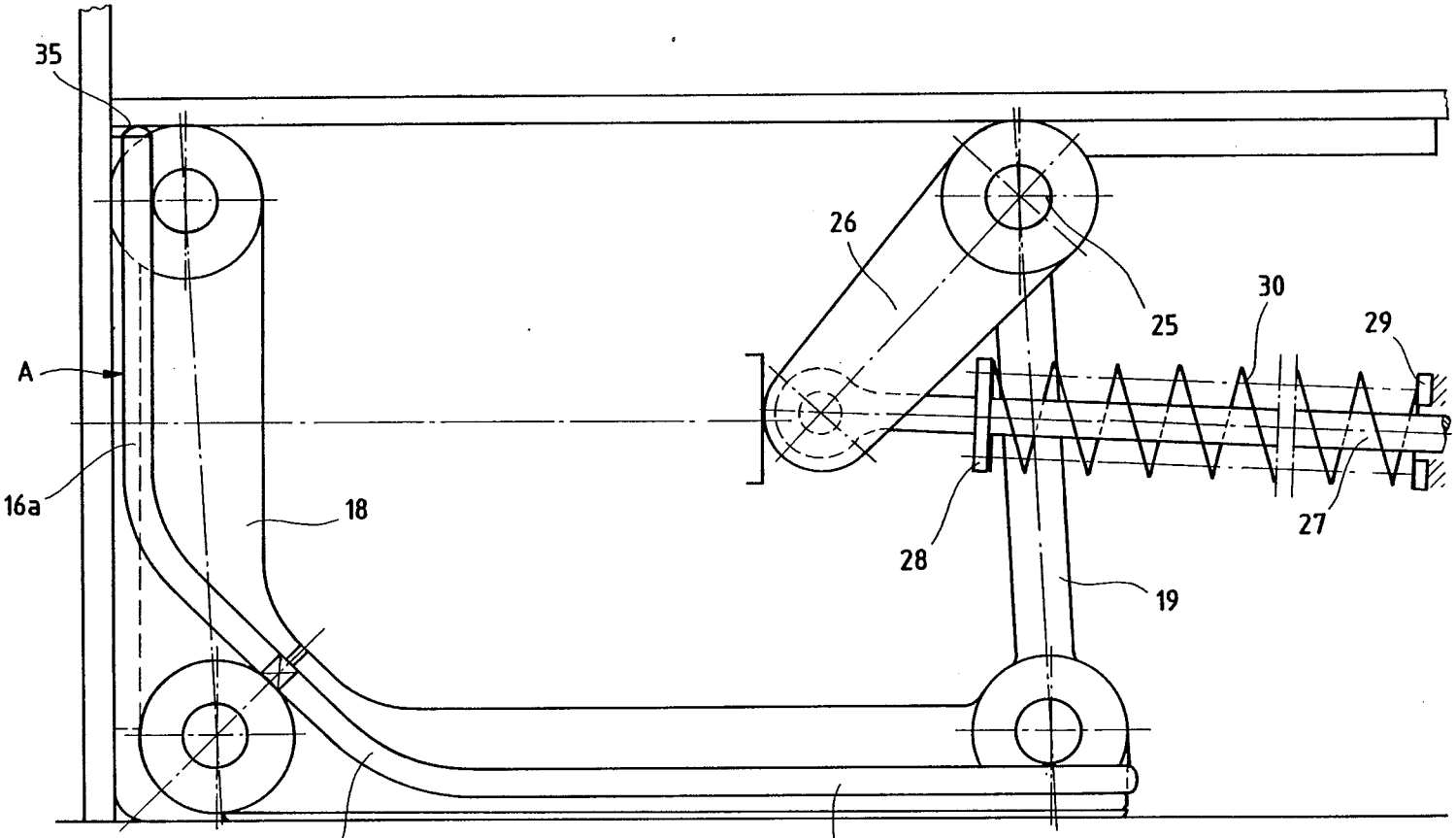
Figure 8:
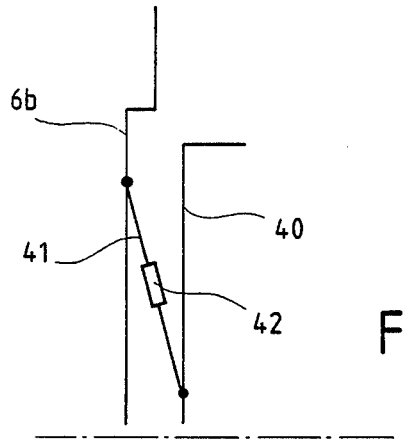
Figure 9:
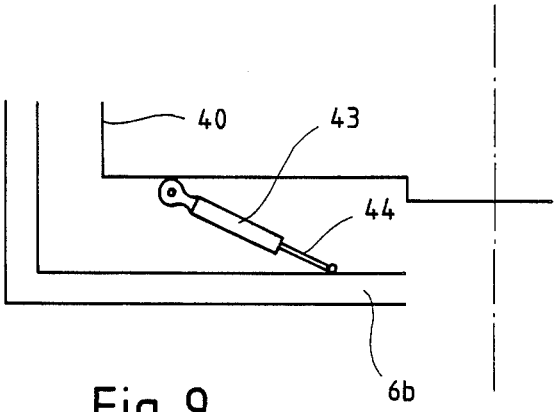

The invention will be further explained hereinbelow with the aid of the drawing whose figures, in schematic fashion, show the following:

FIG. 1 a side elevation of one end of a railroad car configured in accordance with the invention, FIG. 2 a plan view of the floor area of a connecting platform configured in accordance with the invention, FIG. 3 a side view of the front portion of the connecting platforms of two vehicles coupled together, FIG. 4 an enlarged view of a version of a flap in accordance with the invention in the one side wall of the non-flexible tunnel section of the connecting shelter in such a configuration that the connecting platform in accordance with the invention can cooperate with a conventional connecting platform, FIG. 4*a* the system of FIG. 4 as seen in the direction of the arrow 4*a*, FIG. 5 a side elevation of the bottom part of a railroad car configured in accordance with the invention, on a larger scale than in FIG. 1, FIG. 6 an additional detail, FIG. 7 an alternative to the system of FIG. 4, represented in the same manner, FIG. 8 plan view of a pull cable and end abutment arrangement, and FIG. 9 an alternative to the arrangement of FIG. 8.

The inventive connecting platform is associated with the end of a railroad car 1, in which there is a doorway, which can be closed with a door. A bellows 2 is fastened around this doorway against the end of the car, by means of a rear connecting frame 36, and forms a tunnel with floor, roof and sidewalls. The bellows is constructed in a conventional manner by laying a rubberized fabric in folds, which run from the bottom end of the one side wall of the tunnel upward in this side wall into the roof of the tunnel, over the tunnel roof into the top of the other side wall, down through the latter and back to the bottom end, and finally under the connecting platform to the starting point. The bellows is shorter than is generally customary, and is connected at its front end to a non-flexible tunnel section 3, to which is fitted the usual end frame. The non-flexible tunnel section consists of two side walls and the tunnel roof, these parts being joined together in a relatively rigid assembly. At the front end the non-flexible tunnel section is provided with a relatively wide, outwardly turned flange 4, which is provided on its outer face with a wear-resistant covering 4*b*. The non-flexible tunnel section 3 is suspended at its front end directly on the end of the railroad car. For this purpose, coil springs 4*a* are distributed over the length of the collar 4 in the area of the side walls and roof, one end of the springs being fastened to the back of the collar 4 and the other end to the end of the railroad car 1 by means of a connecting frame 4*c*, so that their longitudinal resilience permits the adjusting movements of the tunnel section 3 as the bellows 2 changes shape in accordance with the play in the car coupling 100 and their stiffness perpendicular to their longitudinal axis holds the tunnel section in the intended position over the tracks.

The tunnel-like portion of the shelter formed by the non-flexible tunnel section 3, whose other part is the bellows 2 forming a tube, is also made into a closed tube by a connecting platform 5, which extends into the tubular part of the diaphragm formed by the bellows 2. This connecting platform has a U-shaped bottom reinforcement consisting substantially of two lateral longitudinal members 6*a* and a rear cross member 6*b* (on the car end), which connects the two longitudinal members together fixedly at their rear ends. With this bottom frame 6*a*, 6*b*, there is associated a platform plate 8 vertically pivoted in joints 7 at the rear end. In the vertical, retracted position, the platform plate 8 lies directly in front of the end of the car and lies against it, the doorway being closed by the door. It is important that, independently of the position of the non-flexible tunel section with respect to the end of the railroad car 1, when the platform plate 8 is folded up, the space between the longitudinal members 6*a* and the cross member 6*b* is accessible for a brakeman, so that the car coupling 100 lying between the buffers 101 can be operated in this hatchway in order to couple the car to another car or unhitch it from the latter. When the above-mentioned parts are in the deployed position, the door is to be opened manually, and closed manually or automatically, the bellows 2 is about half extended so that the non-flexible tunnel section 3 is in its forward end position, and the plate 8 of the platform is lowered to its horizontal position, wherein it lies on the longitudinal frame members 6*a*. At the rear end of its bottom reinforcement 6*a*, 6*b*, the connecting platform lies on a stiff car plate 9 affixed to the end of the car and the car's undercarriage. The car plate terminates at its front end approximately in the area, in which the joint between the bellows 2 and the end of the car body 1 is situated when the diaphragm is deployed.

In the area of the lateral members 6*a*, the bottom framing 6*a*, 6*b*, is permanently affixed to the side walls of the tunnel section 3, so that it is suspended at the front as a part of the tunnel section 3 on the above-mentioned coil springs 4*a* at the end of the car, while at the rear end of the bottom reinforcement, i.e., the cross member 6*b*, it is supported on the car (car plate 9). The longitudinal members 6*a* run inside of the bellows 2 along the sides of the car plate 9 and are connected at their rear ends with the cross member 6*b* of the bottom reinforcement above the car plate 9. The supporting of the bottom reinforcement 6*a*, 6*b*, on the car plate 9 is displaceable so as to relieve the coil springs 4*a* and for this purpose a wheel 30 is mounted on the cross member 6*b* at a given distance from each outer end of the rear cross member 6*b* between each pair of brackets 60, the two wheels being rotatable about a common axis of rotation running parallel to the cross member 6*b*. Instead of the wheels, similarly acting slide blocks may be more desirable on account of the necessary transverse displacements between the platform with the bottom reinforcement 6*a*, 6*b*, and the platform plate 8 on the one hand and the car plate 9 on the other when the car shifts sideways. When the bottom reinforcement 6*a*, 6*b*, together with the platform plate 8 approaches the end wall of the car, the car plate 9 slides into a pocket 31 (FIG. 5), which is formed on the bottom of the platform plate 8 by a angle plate 32 attached to its bottom. It is to be noted that the component 8 referred to as the "platform plate" is not a simple, correspondingly thin plate, but a stiff, relatively thick plate-like component reinforced by ribbing to whose bottom the pocket plate 32 is attached in the rearward area. The rear edge 33 of this pocket plate 32 and the forward edge 34 of the car plate 9 are coordinated with one another such that the two edges can move past one another whenever the platform plate 8 is turned about the axes of the joints 7 with the tunnel section 3 in the forward end position. When the platform plate 8 is lowered to its horizontal working position, it lies on flanges 6*d*, which are fastened to the insides of the longitudinal members 6*a*, at such a distance from the tops of the latter that they and the platform plate 8 will be in a common horizontal plane above the track when the platform plate 8 is lowered to its horizontal working position (FIG. 6). Between each of the confronting insides of the longitudinal members 6*a* and hence between the side walls of the tunnel section 3 on the one hand and the lateral edges of the platform plate 8 there is provided a gap, and when the platform plate 8 is lowered to the working position each of these gaps is sealingly filled out by a rubber strip 35, which is preferably an inflatable tube, so as not to be damaged in the deflated state by friction forces when the platform plate 8 swings about, and so as to produce a good and reliable sealing action in the inflated state with the platform plate 8 in the working position. The inflation of the rubber strip can be performed with a hydraulic, but preferably with a pneumatic medium. The valve control being state of the art it is not shown. The two lateral rubber strips 35 are parts of a strand running all the way around and fastened to the platform plate 8, which is fastened to the side and front edges of the platform plate. At the rear end of the platform plate, approximately in the area of the angle plate 32, the strand 35 changes over to the bottom of the angle plate 32 (broken line 35') to lie, when the platform plate 8 is in the deployed position, between the bottom of the angle plate 32 and the top of a cleat 37, which joins together the side members 6*a* of the bottom reinforcement 6*a*, 6*b*, under the car plate 9. In FIG. 1 it is shown schematically how the bellows 2 is joined in an appropriate manner to the non-flexible tunnel section 3 at the front sidewall and roof of the bellows. The bottom of the bellows is fastened at the front end to a side part 37*a* of the above-mentioned cleat 37 and at the rear end the bellows is fastened all the way around to a connecting frame 36, which in turn is associated with the end of the car.

The diaphragm as a whole in this manner forms a tunnel, into which dust, turbulent air and weather cannot enter when it cooperates with a corresponding diaphragm of a following railroad car.

Dust and turbulence are reliably blocked from the interior of the diaphragm even in high-speed trains where the pressure outside of the diaphragm is substantially higher than inside of the diaphragm. This elevated outside pressure has virtually no effect in the interior of the diaphragm.

If two railraod cars with identical diaphragms of the above-described kind are coupled together, the ends of the two platforms abut against one another through the sealing tubes 35 and the diaphagms abut one another at the friction-reducing and wear-resistant coverings 4*b* on the front sides of the collars 4, so that dust and turbulence cannot enter the tunnel interior between the collars and the platform ends, and yet great relative movements are possible between the two parts of the diaphragm system.

To be able to center the platform parts relative to one another vertically in normal running, a groove 13 (FIG. 3), extending symmetrically to both sides of the perpendicular longitudinal central plane of the vehicle is provided on the edge face of each platform, and in it a pin 12, which can be shifted in the longitudinal direction of the car against the action of a compression spring 12*e* is disposed on one side of the vertical longitudinal central plane of the vehicle. At each end of the car the pin 12 is disposed, for example, in the groove on the right side of the perpendicular longitudinal central plane of the vehicle, looking at the end of the car, so that a number of cars can be coupled together in any desired order and there will be a complete connecting diaphragm between every two cars, which will be so protected against external influences that it would even be possible to omit connecting doors on the ends of the cars unless each car should also be usable as the end car of a train. The grooves 13 in the side view (FIG. 3) merge in a continuous arc or in a bevel 13*a* with the top and bottom of the platform plate 8. As the two cars shift against one another the pins 12 under the bias of the springs 12*e* run across the ends of the longitudinal platform members.

If two coupled railraod cars configured in the manner described move relative to one another at their confronting ends, these movements are not substantially hampered by the diaphragm system in accordance with the invention, but on the other hand neither do the movements result in any impairment of the protected action of the diaphragm system. Relative longitudinal movements between cars due to coupling free play will result in corresponding adjusting movements of the non-flexible tunnel section of one or both diaphragm systems or one or both parts of the diaphragm system, and these are easily possible on account of the bellows 2, the adjustable support of the bottom reinforcement 6*a*, 6*b* (wheels 30 or corresponding slide blocks) on the car plates 9, the suspension of the non-flexible tunnel sections 3 on coil springs 4*a* on the ends of the car, and the springing action of the pins 12. The same is the case when the train rounds curves, in that the resilient and longitudinally yielding elements are compressed on the one side of the car on the inside of the curve, and are expanded by the same bias on the other side of the car on the outside of the curve. The wheels 30, or the slide blocks, if used, will in that case shift not only longitudinally but also transversely with respect to the car plate 9. A transverse displacement between the two coupled cars is permitted by the bellows 2, the coil springs or compression springs 4*a* between the ends of the cars and the non-flexible tunnel sections 3, and by the possibility provided for transverse movements of the wheels 30 or corresponding slide blocks with respect to the car plate 9. Upon the maximum transverse shifting of the cars against one another, one centering pin 12 will snap out of the actual grooves and run past the longitudinal platform members at the end of the car.

Railroad cars generally in use today have a different connecting platform design. The platform plates are so long that they reach into the tunnel of the other car.

They overlap on a portion of their length, i.e., in their forward area, and they are supported, if necessary, in the center of the area of the overlap. If such a conventionally equipped railroad car is coupled to a car with a diaphragm system in accordance with the invention, it is basically no problem to let the platform plate of the conventionally equipped car extend into the tunnel of the car equipped in accordance with the invention and lie upon the platform of the latter. However, the danger exists that, when negotiating a curve, a lateral edge of the platform plate of the conventional car may collide with a side wall of the non-flexible section of the diaphragm system of the car equipped according to the invention and, if the curves are tight enough, the platform and/or non-flexible tunnel section may be damaged. To prevent this danger, chambers are created behind the side walls of the non-flexible tunnel section, into which the platform plate of the conventional car can penetrate when rounding a curve, flaps being provided, which usually close off the chambers from the tunnel interior and are opened automatically by the platform plate moving outwardly on the curve and, when this plate returns to its starting position, are automatically returned to their closed positin. Such a system is desirable especially with regard to comfort within the diaphragm if the chambers are open to the vehicle environment or if they are only rudimentary.

Such an arrangement is represented in FIGS. 4 and 4*a*. The opening is a cutout of the lower front part of the one side wall of the non-flexible tunnel section, represented in a horizontal section, and is identified by 14, and the interior of the diaphragm is situated on the left, in the plane of the drawing, of the side wall 3 that is shown. It is of such dimensions that the platform plate of the conventional car can enter without trouble, but without unnecessarily great free play. On the one margin of the opening 14, which is closer to the car, the angular flap 16 is mounted on a pintle 15 for rotation about the longitudinal axis of the pintle. If the above-mentioned platform plate of the conventional car collides with the flap 16, the latter swings into the chamber B behind the vertical wall of the non-flexible tunnel section and permits the platform plate to enter without damage into the space or chamber behind the side wall. This can best cause a spring 17 to be compressed, which returns the flap 16 to its starting position when the pressure of the platform plate ceases, i.e., the latter returns to its starting position. For this purpose a shackle 20 is fastened to the flap 16 and between its two arms a cup 21 is journaled on a pin 26 with the coil spring 17 thrusting against its bottom, the coil spring surrounding a spring rod 24, which is fastened to the bottom of the cup. The other end of the spring rod is brought through a fixed abutment 25 against, which the other end of the spring 17 thrusts, and the rod is adjustable longitudinally. The flap 16 is surrounded by a rubber tube 35, which corresponds to the tube 35 between the platform plate and the bottom reinforcement 6*a*, 6*b*, and cooperates with the fixed edge 40 of the opening 14. In the position of rest, which is shown, the leg 16*a* of the angular flap 16 is a prolongation of the non-flexible tunnel section 3, and the other leg 16*b* is a prolongation of the collar 4.

A different embodiment is represented in FIG. 7. Here the flap plates 16*a* and 16*b* are journaled on a parallelogram linkage 16*a*, 18, 19, which permits the flap plates to give way under the effect of the platform plate colliding with it (arrow A). The parallelogram linkage is also spring-loaded. A lever 26 is mounted for co-rotation with the shaft 25, which rotates when the link 19 swings, and a rod 27 is linked to its outer end, and a spring abutment 28 is fastened to the outer end of lever 26 whose other end is passed through a fixed spring abutment so as to be axially adjustable. Between the spring abutments 28 and 29 there is disposed a coil spring, through which the spring rod 27 is passed.

Here again the flap plates 16*a* and 16*b* are bound by sealing tubes 35, which seal the gap between the flap and the edge of the opening when the flap is in its closed position.

As it can be seen, the diaphragms of two cars coupled together are not fastened together. Under the action of springs 4*a* the front end frames 4 thrust against one another with a certain bias and can slide relative to one another, and in order to assure the same action between the edge surfaces and seals 35*a* of the platform plate 8 and of the side members 6*a* of both of the diaphragm systems between two cars, springs can be installed between the cross member 6*b* of each bottom reinforcement 6*a*, 6*b* and the end of the pocket above the car plate 9, which urge the bottom reinforcement with the platform plate 8 out of the above-mentioned pocket. This reliably assures that diaphragm systems and platforms of the diaphragm systems of two cars coupled together will reliably engage one another frontally without having to be fastened mechanically together.

This does not exclude the possibility that the two diaphragm systems might shift relative to one another laterally and relative to their respective cars to a greater extent than intended. For that reason the lateral relative movement between diaphragm system and car is restricted first by springs and ultimately by end abutments. In FIGS. 8 and 9 examples of this are shown. According to FIG. 8, a cable 41 with a cable tightener 42 is connected between a part of the platform, especially the cross member 6*b* of the bottom reinforcement 6*a*, 6*b*, and a part 40 affixed to the end wall, and runs from one side to the other. When lateral movements of the cross member 6*b* occur, and thus lateral movements of the diaphragm system, the one cable is lengthened while the other cable is shortened accordingly, which is possible without slackening on account of the cable tightener 42. The relative movement between the diaphragm system and car is limited by the maximum cable pull-out or by an associated abutment. Another embodiment is represented in FIG. 9. Between the bottom of a housing 43 and a piston 44 there is disposed a coil spring, which can be considered to be blocked. The connecting rod 44 or housing 43 is articulated to the car, while the housing 43 or piston rod 44 is articulated to the platform. The cars and diaphragm can approach one another until the compressively stressed spring of two similar diaphragms becomes blocked. In the case of a spring, which cannot be considered to be blocked, a correspondingly located abutment can go into action. This is the case especially when a tension spring is used, which cannot be fully extended. If springs are used as parts of the paired apparatus, they have a centering effect on the diaphragm.

To sum up, the diaphragm system in accordance with the invention can be described with its essential features as follows:

The object of the invention is a diaphragm for passenger railway cars, which consists of a platform 5 and a diaphragm 36, 2, 3 disposed in tunnel fashion over the platform. The system is so constructed that it provides good protection for the interior against external influences even when the differences in pressure between the outside and inside are extreme. The tunnel-like diaphragm consists of an inner end frame 36 for fastening to one of two railroad passenger cars coupled together, an outer end frame 3 for cooperation with the outer end frame of the connecting platform of the second of two coupled railroad passenger cars, and a resilient member, especially a bellows 2 between the two end frames 36 and 3. The outer end frame 3 is suspended by springs 4*a* directly on one of the two passenger cars, and the springs exert an outwardly directed force on the outer end frame 3. The connecting platform is made in two parts, of which an inner part 9 is fastened to one of the two passenger cars to be coupled together, and the other, outer part 6*a* is displaceably supported at the rear end on the inner part, is joined to the outer end frame 3 at the front end, and terminates in the same vertical cross plane as the outer end frame. The outer end frame is provided with a thrusting surface 4, 4*b*, so that, when two passenger train cars are coupled together, the connecting platforms and the shelter means of the two diaphragm systems will abut one another face to face and be held in contact with one another by the springs 4*a*, so that no fastening means are needed, and yet the junction between the two diaphragms is sealed off, even when allowable lateral shifting between the two diaphragms takes place. The diaphragm and platform are sealed against one another. The outer end frame 3 is of a tunnel-like configuration, and its relatively long side walls have flaps in the front, lower region, which close openings, into which the platform of a second passenger train coupled to the first can enter when this platform deviates from the platform of the other car such that it enters in the form of a plate into the diaphragm system of the first car and rests upon its connecting platform.

We claim:

1. A connecting platform system for a railroad car, for cooperation with a platform system of another car articulated to said railroad car, the system comprising:

an inner end frame adapted to be fastened to an end of the railroad car, an outer end frame having a tunnel-like configuration, spaced from the inner end frame, a tunnel-like bellows extending between the two end frames, spring means for supporting the outer end frame on the railroad car, the spring means holding the outer end frame away from the railroad car and toward the outer end of a platform system of another car, a car plate fixed to the railroad car, a bottom reinforcement joined at its outer end to the bottom of the outer end frame, the bottom reinforcement being movably supported at its inner end on the car plate, and a platform plate resting on the reinforcement, whereby when said railroad car and another car are coupled together, the spring means will maintain the outer end of the connecting platform system of said railroad car in engagement with the outer end of the platform system of said another car without the need for fastening means between the two platform systems.

2. A connecting platform system as defined in claim 1 wherein the bellows is a tube running along the outer frame and beneath the platform plate.

3. A connecting platform system as defined in claim 1 including wheels supporting the bottom reinforcement on the car plate, the wheels being rotatable on a common axis transverse to the longitudinal direction of the railroad car.

4. A connecting platform system as defined in claim 1 including a pocket carried by the platform plate, the pocket accommodating the car plate to different depths in response to movements of the bottom reinforcement with respect to the car plate.

5. A connecting platform system as defined in claim 1 wherein the bottom reinforcement carries supports for the platform plate, the supports being so located that when the platform plate rests upon the supports, the upper surfaces of the bottom reinforcement and platform plate all lie in the same horizontal plane.

6. A connecting platform system as defined in claim 5 wherein the bottom reinforcement is U-shaped, the platform plate fitting within the U-shape, and including a gasket between each side and the and the end of the reinforcement and the adjacent edge of the platform plate.

7. A connecting platform system as defined in claim 6 wherein the gasket is an inflatable tube.

8. A connecting platform system as defined in claim 1 including side wall flaps swingably mounted at the lower ends of the outer end frame, the flaps defining pockets for accommodating to varying depths the connecting platform system of another car coupled to said railroad car.

9. A connecting platform system as defined in claim 8 including a gasket between each flap and the outer end frame.

10. A connecting platform system as defined in claim 9 wherein the gasket is an inflatable tube.

11. A connecting platform system as defined in claim 10 wherein the internal pressure of the tube is variable by means of a pneumatic pressure medium.

12. A connecting platform system as defined in claim 8 wherein each flap has an angle cross-section and is pivoted to the outer end frame on a vertical axis.

13. A connecting platform system as defined in claim 8 including a swingable parallelogram linkage supporting each flap with respect to the outer end frame.

14. A connecting platform system as defined in claim 8 including a return spring which when unstressed maintains each flap in the plane of the outer face of the outer end frame.

15. A connecting platform system as defined in claim 1 including a yieldable guide carried by the platform plate for horizontally guiding the connecting platform system with respect to a similar system of another car.

16. A connecting platform system as defined in claim 15 wherein the guide includes a yieldable pin projecting from the front edge of the platform plate, and a horizontal recess extending along the front edge of the platform plate for slidably accommodating a yieldable pin of another connecting platform system.

17. A connecting platform system as defined in claim 16 wherein the pin is displaceable against the force of a compression spring.

18. A connecting platform system as defined in claim 16 including transitional arcs or chamfers along the top and bottom corners of the front edge of the platform plate.

19. A connecting platform system as defined in claim 1 including means, mounted between two cooperating connecting platform systems of two railroad cars, for damping and limiting the relative lateral movements between the two systems.

20. A connecting platform system as defined in claim 19 wherein the damping and limiting means includes two pull cables.

21. A connecting platform system as defined in claim 19 wherein the damping and limiting means includes two compressible spring members.

22. A connecting platform system as defined in claim 19 wherein the damping and limiting means includes abutments which engage when the damping means reach an extreme position.

23. A connecting platform system as defined in claim 1 wherein the bottom reinforcement is U-shaped, and the platform plate is pivotable upwardly from the reinforcement to permit access to the region beneath the platform plate.

24. A connecting platform system as defined in claim 1 including sealing means between the platform plate and the bellows for sealing the interior of the bellows from pressure waves which develop when two trains approach each other in a tunnel.

* * * * *